US006119645A

United States Patent [19]

Hesher

[11] Patent Number: 6,119,645

[45] Date of Patent: Sep. 19, 2000

[54] VALVE STEM SEAL WITH NON-ROTATABLE RETAINER

[75] Inventor: Eric W. Hesher, Avilla, Ind.

[73] Assignee: Dana Corporation, Toledo, Ohio

[21] Appl. No.: 09/250,356

[22] Filed: Feb. 16, 1999

[51] Int. Cl.[7] ..... F02N 3/00

[52] U.S. Cl. ..... 123/188.6

[58] Field of Search ..... 123/90.65, 90.66, 123/90.67, 188.6, 188.11, 188.12, 188.13, 188.17

[56] References Cited

U.S. PATENT DOCUMENTS

| | | | |
|---|---|---|---|
| 1,595,317 | 8/1926 | Scholey | 123/90.67 |
| 1,878,128 | 9/1932 | Griswold . | |
| 2,613,656 | 10/1952 | Leach | 123/90.66 |
| 2,868,188 | 1/1959 | Havens | 123/90.67 |
| 2,935,979 | 5/1960 | Havens | 123/90.67 |
| 3,114,361 | 12/1963 | Mullen . | |
| 4,470,383 | 9/1984 | DeBolt | 123/90.65 |
| 4,993,376 | 2/1991 | Fukutome et al. . | |
| 5,044,330 | 9/1991 | Havens et al. | 123/90.67 |
| 5,570,663 | 11/1996 | Shida | 123/188.11 |

FOREIGN PATENT DOCUMENTS

| | | | |
|---|---|---|---|
| 1 189 792 | 12/1983 | Germany | 123/90.66 |
| 53-90513 | 8/1978 | Japan | 123/188.12 |
| 58-220910 | 12/1983 | Japan | 123/90.65 |

*Primary Examiner*—Noah P. Kamen
*Attorney, Agent, or Firm*—Rader, Fishman & Grauer PLLC

[57] ABSTRACT

A valve spring seat is disclosed having at least one annular flange in facing relationship with a surface of an engine head. The flange may be part of a valve seal retainer. A radial cut extending inwardly from the radially outermost edge of the flange to an intermediate position on the flange forms two opposing free edges. The first edge is bent in a first longitudinal direction to form a first tab, and the second edge is bent in a second, opposite longitudinal direction to form a second tab. The first tab engages at least one coil of the valve spring, and the second tab engages the cylinder head to prevent rotation of the spring during reciprocation of the spring.

20 Claims, 2 Drawing Sheets

VALVE STEM SEAL WITH NON-ROTATABLE RETAINER

FIELD OF THE INVENTION

The present invention relates to internal combustion engine valve seal retainers, and more particularly to an annular retainer having at least two tabs for respectively engaging an end of a valve spring and the engine cylinder head to prevent unwanted valve rotation.

BACKGROUND OF THE INVENTION

In conventional overhead valve internal combustion engines, at least two valves reciprocate to provide intermittent communication between intake and exhaust manifolds and a combustion chamber. The valves include valve stems that are commonly disposed in valve stem guides, supporting axial motion in an engine component such as an engine head. Lubrication is provided to upper portions of the valve stems by a spray of lubricating oil within a valve cover disposed over the engine head or by gravity flow from an associated rocker arm. Oil flows by the force of gravity and may be encouraged by a pressure differential in the manifold versus crankcase pressure along a free upper end of the valve stem toward the manifolds and valve heads.

Valve guide seals located between the valve stem and the valve guide serve various purposes. First, they minimize engine oil consumption by restricting oil entry into the manifold and the combustion chamber. Second, they help to minimize exhaust particulates that contribute to pollution. Third, they are helpful in minimizing guide wear, which is of particular importance with diesel engines due to the nature of their operation.

The valve stem, valve guide, and valve guide seals are annularly wrapped by a helical compression valve spring that serves to bias the valve into a closed position. The longitudinal ends of the valve spring are restrained by flanges on corresponding valve stem seal retainers, valve spring retainers and/or spring seats, thereby maintaining proper alignment and position of the valve and valve spring. Typically, a flange on the valve stem seal retainer captures the lower end of the valve spring, but is not affixed to any other engine part. During engine operation, the valves are opened by transmitting drive forces from cams that are rotating in synchronism with the engine rotation to the stem ends of the valves via rocker arms.

As the valves are opened, the helical valve spring compresses, resulting in a rotational torque being exerted against the valve stem seal retainers or spring seats. This torque tends to cause the valve seal, the valve guide, the valve stem seal retainers and/or the valve stem (i.e. anything connected to the valve spring) to rotate slightly during each valve reciprocation. In most engines, valves are not designed to rotate, so the rotative torque applied by the compressed valve spring is undesirable. However, in some engines, especially those engines that use cruder fuels, the valves are specifically intended to rotate a precise amount with each reciprocation so that harmful deposits may be scrubbed from the valve and valve seat surfaces. Valve rotation in these types of engines is accomplished by precision valve rotators, which are designed to rotate the valve a predetermined amount for each actuation of the valve. However, the rotative torque applied by the compressed valve spring during each actuation causes either more or less valve rotation than intended, thereby impacting the efficiency of the valve scrubbing process. It is therefore desirable to limit the rotative force component caused by compressed valve springs to more closely control the valve rotation.

SUMMARY OF THE INVENTION

The present invention is directed to a valve stem seal retainer having at least one annular flange in facing relationship with a surface of an engine head. The flange includes at least two tabs. The first tab engages at least one coil of a valve spring, and the second tab engages the cylinder head to prevent rotation of the tab retainer and the spring.

In a preferred embodiment, the annular flange includes a radial cut extending inwardly from the radially outermost edge of the flange to an intermediate position on the flange, thereby forming two opposing free edges. The first edge is bent in a first generally longitudinal direction to form a first tab, and the second edge is bent in a second, opposite generally longitudinal direction to form a second tab. The first tab engages at least one coil of the valve spring, and the second tab engages the cylinder head to prevent rotation of the spring.

Because one tab engages the engine head while the other tab engages the helical spring, the bottom of the helical spring is locked against rotation caused by inherent spring compression torque. In those engines where valve rotation is undesirable, the tabs on the valve retainer lock the entire valve assembly against rotation, thereby maintaining the valve in a stationary location. When valve rotation is required and performed by precision valve rotators attached to an upper portion of the valve stem, the tabs in the valve retainer flange fix the bottom of the valve spring against unwanted rotation, thereby allowing the valve rotators exclusive and optimum control over the valve rotation.

In both situations, where valve rotation is either desired or undesired, wear of the valve guide inner surface is minimized by controlling excess wear caused by irregularities between the external surface of the valve stem and the internal surface of the valve guide. As a result, valve guide life is increased, while excessive oil consumption and low compression due to inadequate valve sealing is avoided.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE PREFERRED EMBODIMENTS

Figure 1:
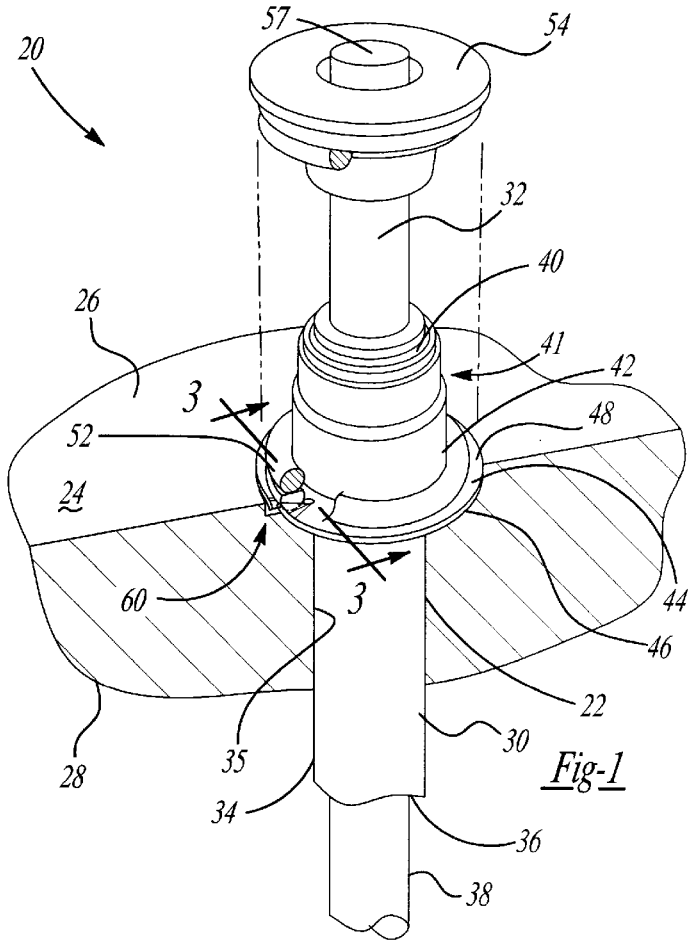
FIG. 1 is a perspective view of a first embodiment of the present invention showing upper and lower valve spring retainers.
Figure 2:
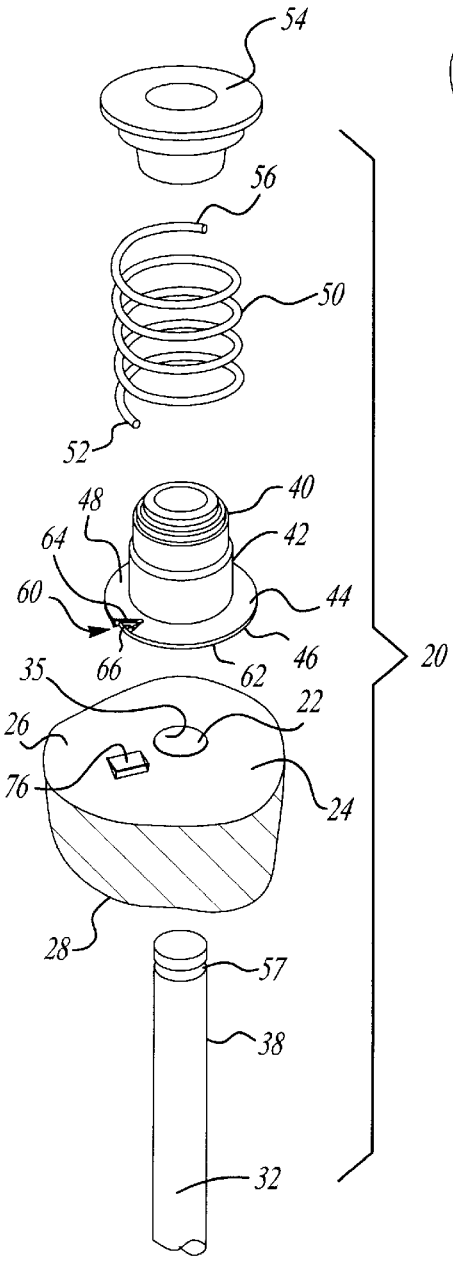
FIG. 2 is an exploded perspective view of a portion of the valve assembly of the present invention.

As seen in FIGS. 1 and 2, an internal combustion engine valve assembly 20 is adapted to be received in an axially extending bore 22 of an internal combustion engine component such as an engine head 24. Engine head 24 includes an upper axial surface 26 and a lower axial surface 28.

Valve assembly 20 includes an annular valve stem guide 30 surrounding a valve stem 32. Valve stem guide 30 may comprise two distinct annular guide sections (not shown), and may be formed from powdered metal. The radially outer surface 34 of the valve stem guide 30 closely corresponds to the diameter of bore 22 such that a very tight fit results between the valve stem guide 30 and the bore wall 35 when the valve stem guide 30 is inserted. Likewise, the diameter of the radially inner surface 36 of the valve stem guide 30 closely corresponds to the diameter of the radially outer surface 38 of the valve stem 32, resulting in a tight fit between the valve stem and the valve guide, though no so tight as to prevent the valve stem 32 from reciprocating within the valve stem guide 30. A resilient sealing member 40 about the upper end 41 of the valve stem guide 30 extends longitudinally over a portion of both the outer surface 38 of the valve stem 32, and over a portion of the outer surface 34 of the valve stem guide 30. As noted above, the sealing member 40 serves several purposes. First, sealing member 40 limits oil entry into the manifold and the combustion chamber. Second, sealing member 40 acts to minimize exhaust particulates that contribute to pollution. Third, sealing member 40 is helpful in minimizing wear of valve stem guide 30.

Sealing member 40 is held in place by an annular valve stem seal retainer 42, typically of metal construction. In addition, the seal retainer 42 is formed with an annular flange 44 having a bottom surface 46 that rests in facing relationship with the upper surface 26 of the engine head 24. The top surface 48 of the flange 44 acts a seat for a helical spring 50, a lower portion 52 of which is shown in FIG. 1. It should be noted that seal retainer 42 may comprise both a seal retainer portion and a separate support in the form of a separate hardened washer (not shown). In such an arrangement, the hardened washer includes a flanged portion interposed between lower portion 52 of spring 50 and the upper surface 26 of the engine head 24, thereby providing a seat for the helical spring 50.

In addition, an upper spring retainer 54 of conventional design restrains the upper portion 56 of spring 50. Upper spring retainer 54 is removably attached to an upper portion 57 of valve stem 32 such that spring retainer 54 reciprocates with valve stem 32, thereby compressing spring 50.

Figure 3:
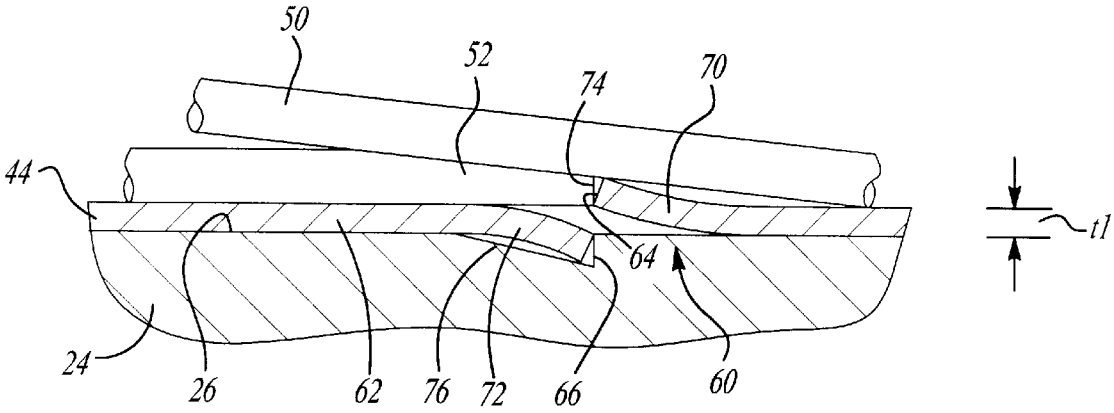
FIG. 3 is view of a cross-section of the present inventive non-rotatable valve stem seal retainer taken along line 3—3 of FIG. 1.

According to the present invention, and with reference to FIGS. 1, 2 and 3, annular flange 44 includes a radial cut 60 extending inwardly from the radially outermost edge 62 of flange 44 to a predetermined intermediate point on the flange 44, thereby forming two opposing free edges 64, 66. One of opposing free edges 64, 66 is bent upwardly to form a first tab, while a second of opposing free edges 64, 66 is bent downwardly to form a second tab. The amount that free edges 64, 66 are bent upwardly or downwardly is determined by the specific engine design, but most engines will require that free edges 64, 66 be bent an amount t1 equal to between 0.010 to 0.125 inches (3 mm). Likewise, the choice of which free edge to bend upwardly or downwardly is determined by the orientation of spring 50 and the specific engine design. In the assembly shown in the Figures, used henceforth for illustrative purposes, spring 50 coils clockwise from bottom to top. It should be understood, however, that the following description of the structure of the inventive flange is reversed if the spring coils in the opposite direction.

Because spring 50 coils clockwise from bottom to top in FIGS. 1–3, the first free edge 64 is bent upwardly to form a first tab 70, while the second free edge 66 is bent downwardly to form a second tab 72. As best seen in FIG. 3, first free edge 64 abuts end 74 of lower portion 52 of spring 50. At the same time, second free edge 66 is received within a void 76 cast into the upper surface 26 of the engine head 24. It is important to note that, especially for aftermarket installations, the void 76 for receiving second tab 72 may not be formed in every engine head. However, after the stamping process to form cut 60 and tabs 70 and 72, valve seal retainer 42 is preferably case hardened, thereby developing sufficient hardness so that second tab 72 is able to frictionally engage the upper surface 26 of the engine head 24 even without the void 76.

As spring 50 compresses during valve actuation, an inherent rotational torque is created that tends to rotate the valve assembly 20. In most engines, rotation of the valve assembly is not desirable, as it could lead to premature wear of the inner bearing surface 36 of the valve stem guide 30, or tend to trap abrasive contaminants between the valve stem guide 30 and the valve stem 32. In both cases, valve efficiency would be adversely impacted by valve rotation. The present invention addresses these problems. The combination of the first tab 70 engaging the lower portion 52 of spring 50 and the second tab 72 engaging the upper surface 26 of the engine head 24 serves to limit rotation of the spring 50, and the entire valve assembly 20, during reciprocation of the engine.

However, as noted above, some engines, especially those engines that use cruder fuels, are specifically designed such that engine intake and exhaust valves are rotated with each reciprocation to "scrub" harmful deposits from the valve and valve seat surfaces. Precision valve rotators are used in these types of engines, which are designed to rotate the valve a predetermined amount for each actuation of the valve. Undesirably, the actual amount of valve rotation is made imprecise because the rotative torque applied by the compressed valve spring during each reciprocation causes either more or less valve rotation than intended or designed, thereby impacting the efficiency of the valve scrubbing process. A second embodiment of the present invention, useful to limit the rotative force component caused by compressed valve springs and to more closely control the valve rotation, is shown with reference to FIG. 4.

Figure 4:
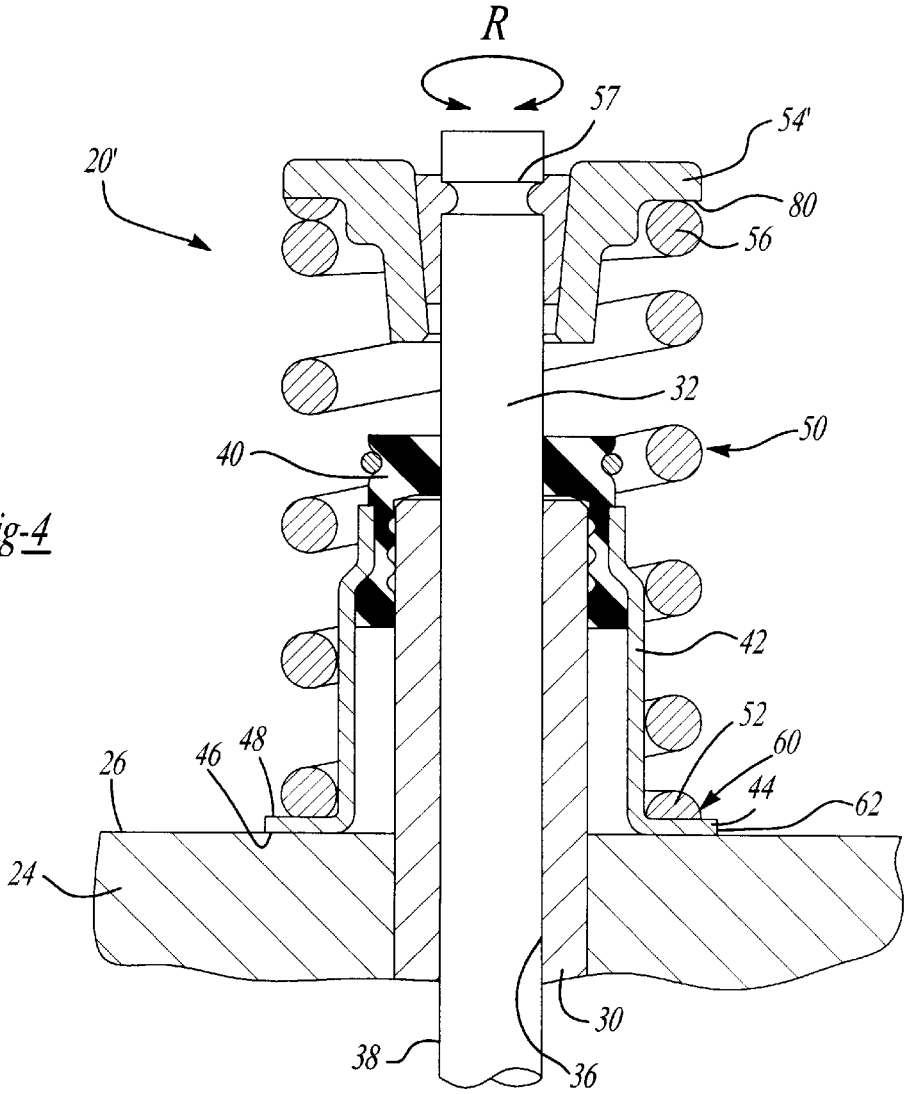
FIG. 4 is a cross-sectional view of the valve assembly of the present invention including a valve rotator for controlling the rotation of the valve.

The assembly 20' of FIG. 4 contains many of the same components shown in FIGS. 1–3 above, wherein like numbers depict like structures. However, rather than supplying an upper spring retainer, a valve rotator 54' is supplied that is fixedly attached to the upper end 57 of the valve stem 32. The valve rotator 54' does provide similar function to an upper spring retainer, i.e. restraining the upper portion 56 of spring 50 such that valve rotator 54' reciprocates with valve stem 32 and compresses spring 50. But the primary purpose of valve rotator 54' is to rotate the valve stem 32 a predetermined amount R with each valve reciprocation. Valve rotator 54' may be of any conventional design, and provides a spring seat 80 for receiving the upper portion 56 of the valve spring 50. Conventionally, during valve reciprocation, the valve rotator 54' rotates the valve stem 32 a predetermined precise amount R in either the clockwise or counterclockwise direction. However, because of the inherent torque supplied by compression of the valve spring 50, the amount that valve stem 32 is actually rotated is either more or less than the designed amount R because the lower parts of valve assembly 20' are not fixed into place.

To more precisely control the rotation, the valve assembly 20' of FIG. 4 also includes the annular valve stem seal retainer 42 on the lower portion of the valve assembly 20'. The valve stem seal retainer has the same structure and description as discussed above and as shown in detail in FIG. 3. As applied to the embodiment of FIG. 4, the inventive valve stem seal retainer 42 prevents the lower portion of valve assembly 20' from rotating independently as a result of the inherent torque supplied by the compressed spring 50. Thus, rotation of the valve assembly 20' is provided only by the valve rotator 54', and excess rotation from the spring torque is eliminated. As a result, valve rotation may be very precisely controlled. In engines where valve rotation is required, such precise control will prevent localized buildup of engine deposits. Precise rotation control also allows control of wear of both the inner surface 36 of valve stem guide 30 and the exterior surface 38 of valve stem 30, thereby increasing the useful life of the valve assembly 20', and a corresponding increase in the useful life of an engine.

Preferred embodiments of the present invention have been disclosed. A person of ordinary skill in the art would realize, however, that certain modifications would come within the teachings of this invention. Therefore, the following claims should be studied to determine the true scope and content of the invention.

I claim:

1. In a valve assembly of an internal combustion engine having at least one valve spring seat adjacent a surface of an engine head, wherein the valve spring seat includes an annular flange in facing relationship with the surface, an apparatus for preventing undesired rotation of the valve assembly, comprising:

a cut in the flange forming two opposing free edges, said first free edge being bent in a generally longitudinal first direction to form a first tab for engaging the surface of the engine head, said second free edge being bent in a generally longitudinal second direction to form a second tab for engaging at least one coil of a valve spring.

2. The apparatus as in claim 1, wherein said cut is a radial cut extending from a radially outermost edge of the flange to an intermediate portion there.

3. The apparatus of claim 1, wherein said cut and said tabs are formed by stamping.

4. The apparatus of claim 1, wherein the surface of the engine head further includes a void for receiving said second tab.

5. The apparatus of claim 4, wherein the first and second tabs are respectively bent an amount between 0.010 to 0.125 inches (3.2 mm).

6. The apparatus of claim 5, wherein the flange is part of a hardened washer.

7. The apparatus of claim 6, wherein the flange is part of a valve seal retainer.

8. The apparatus of claim 7, wherein the flange is case hardened after stamping to a hardness greater than the surface of the engine head.

9. The apparatus of claim 1, wherein the surface of the engine head further includes a void for receiving said first tab.

10. A non-rotating valve stem seal retainer comprising:

at least a portion of the valve stem seal defining an annular flange in facing relationship with a surface of an engine head, wherein said flange includes a cut forming two opposing free edges, said first free edge being bent in a generally longitudinal first direction to form a first tab for engaging the surface of the engine head and said second free edge being bent in a generally longitudinal second direction to form a second tab for engaging at least one coil of a valve spring.

11. The apparatus as in claim 10, wherein said cut is a radial extending from a radially outermost edge of the flange to an intermediate portion there.

12. The apparatus of claim 11, wherein the flange includes a radial cut in the flange extending from a radially outermost edge of the flange to an intermediate portion thereof forming two opposing free edges, said first free edge bent in said first generally longitudinal direction to form said first tab and said second edge being bent in said second generally longitudinal direction to form said second tab.

13. The apparatus of claim 12, wherein said surface of said engine head further includes a void for receiving said second tab.

14. The apparatus of claim 13, wherein the first and second tabs are respectively bent an amount between 0.010 to 0.125 inches (3.2 mm).

15. The apparatus of claim 14, wherein said cut and said tabs are formed by stamping.

16. The apparatus of claim 10, wherein at least said flange is case hardened after stamping to a hardness greater than the surface of the engine head.

17. A reciprocating valve spring assembly for precisely controlling the rotation of a valve in an internal combustion engine, comprising:

a helical compression spring having first and second ends;

a first spring seat supporting said first end of said spring adjacent a surface of an engine head, said spring seat including an annular flange in facing relationship with said surface;

a radial cut in said flange extending from a radially outermost edge of said flange to an intermediate portion thereof forming two opposing free edges, said first free edge bent in a first longitudinal direction to form a first tab for engaging at least one coil of said spring and said second edge being bent in a second longitudinal direction to form a second tab for engaging said surface; and a valve rotator including a second spring seat supporting said second end of said spring adjacent a distal end of a valve stem, said valve rotator fixedly attached to said distal end of said valve stem, said valve rotator rotating said valve stem a predetermined amount for every reciprocation of the valve spring assembly.

18. The assembly of claim 17, wherein said surface of said engine head further includes a void for receiving said second tab.

19. The assembly of claim 18, wherein the first and second tabs are respectively bent an amount between 0.010 to 0.125 inches (3.2 mm).

20. In a valve assembly of an internal combustion engine having at least one valve spring seat adjacent a surface of an engine head, wherein the valve spring seat includes a generally planar annular flange in facing relationship with the surface, an apparatus for preventing undesired rotation of the valve assembly, comprising:

a cut in the planar flange forming two opposing free edges, said first free edge being bent in a first direction away from the planar flange to form a first tab for engaging the surface of the engine head, said second free edge being bent in a second direction away from the planar flange to form a second tab for engaging at least one coil of a valve spring.

* * * * *